US007252540B2

(12) United States Patent
Tanaka

(10) Patent No.: US 7,252,540 B2
(45) Date of Patent: Aug. 7, 2007

(54) ELECTRICAL CONNECTOR SUITABLE FOR TRANSMITTING A HIGH-FREQUENCY SIGNAL

(75) Inventor: Yukitaka Tanaka, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 11/544,060

(22) Filed: Oct. 6, 2006

(65) Prior Publication Data

US 2007/0082555 A1 Apr. 12, 2007

(30) Foreign Application Priority Data

Oct. 7, 2005 (JP) ..... 2005-295117

(51) Int. Cl.
*H01R 12/24* (2006.01)

(52) U.S. Cl. ..... 439/497

(58) Field of Classification Search ..... 439/497, 439/498, 660, 924, 708, 638, 926
See application file for complete search history.

(56) References Cited

U.S. PATENT DOCUMENTS 3,447,120 A * 5/1969 Rask et al. ..... 439/497
4,749,371 A * 6/1988 Hirai et al. ..... 439/497

* cited by examiner

*Primary Examiner*—Phuong Dinh
(74) *Attorney, Agent, or Firm*—Collard & Roe, P.C.

(57) ABSTRACT

In an electrical connector for connecting first and a second connection objects through a plurality of contacts, a housing includes a front housing for receiving the first connection object and a rear housing coupled to the front housing in a first direction and for receiving the second connection object. The contacts include first and second signal contacts and a first and a second ground contacts. Front contacting portions of the fist signal contact and the first ground contact and front contacting portions of the second signal contact and the second ground contact are arranged on different rows in the front housing. Rear contacting portions of the fist signal contact, the second signal contact, and the first ground contact and rear contacting portion of the second ground contact are arranged on different rows in the rear housing.

11 Claims, 14 Drawing Sheets

14-14

14-14

ELECTRICAL CONNECTOR SUITABLE FOR TRANSMITTING A HIGH-FREQUENCY SIGNAL

This application claims priority to prior Japanese patent application JP 2005-295117, the disclosure of which is incorporated herein by reference.

BACKGROUND OF THE INVENTION

This invention relates to an electrical connector for electrically connecting two connection objects and, in particular, to an electrical connector suitable for transmitting a high-frequency signal, such as a digital signal, between two connection objects.

As an electrical connector of the type, there is known an electrical connector according to the HDMI (High-Definition Multimedia Interface, HDMI is a trademark or a trademark registration of HDMI Licensing, LLC) standard. Referring to FIGS. 1A, 1B, and 2, examples of use of conventional electrical connectors will be described.

Referring to FIG. 1A, a first example will be described. A right-angle connector 800 as a receptacle connector according to the HDMI standard (may simply be referred to as a HDMI receptacle connector) is mounted to a digital electronic apparatus 500 such as an optical disk recorder. The connector 800 serves to connect a peripheral apparatus (not shown) such as a digital display or an associated apparatus (not shown) such as a set-top box (STB) for cable television broadcasting to the digital electronic apparatus 500 through a plug harness 200 according to the HDMI standard (may simply be called a HDMI plug harness).

The electronic apparatus 500 comprises a casing 501, a main board 502, and a subsidiary board 506. The main board 502 and the subsidiary board 506 are disposed inside the casing 501. The kind of subsidiary board serves as an interface for contact pitch-converting between two electrical connectors connected to the subsidiary board.

On the main board 502 provided with a conductor having a circuit pattern, a receptacle connector 504 and various electronic devices (not shown) forming an electronic circuit and including a CPU (Central Processing Unit) are mounted.

On the subsidiary board 506 similarly provided with a conductor having a circuit pattern, the above-mentioned right-angle connector 800, various electronic devices including a digital transmission chip 503, and a receptacle connector 507 are mounted. The electronic devices are not illustrated in the figure except the digital transmission chip 503. The digital transmission chip 503 serves to perform bidirectional conversion between a signal according to a standard processed by the electronic circuit formed on the main board 502 and a signal according to the HDMI standard (may simply be called a HDMI signal).

Those elements, such as the connectors and the electronic devices, mounted on the main board 502 and the subsidiary board 506 are fixed to and electrically connected thereto by soldering leads, pins, or lands of the elements to corresponding lands formed on these boards.

The main board 502 and the subsidiary board 506 are connected to each other through a flexible flat cable (FFC) 505 having plug connectors formed at opposite ends thereof. Instead of the FFC 505, a flexible printed circuit (FPC) may be used. For convenience of assembling and maintenance of the electronic apparatus 500, the plug connector at one end of the FFC 505 is adapted to be removably fitted to the receptacle connector 504 mounted on the main board 502. Similarly, the plug connector at the other end of the FFC 505 is adapted to be removably fitted to the receptacle connector 507 mounted on the subsidiary board 506.

Referring to FIGS. 1B and 2, a second example will be described. The right-angle connector 800 as a HDMI receptacle connector is mounted to a digital electronic apparatus 600 in order to connect a peripheral apparatus (not shown) to the digital electronic apparatus 600 through the HDMI plug harness 200.

The electronic apparatus 600 comprises a casing 601, a main board 602, and a subsidiary board 606. The main board 602 and the subsidiary board 606 are disposed inside the casing 601.

On the main board 602 provided with a conductor having a circuit pattern, various electronic devices including a CPU and a digital transmission chip 603, and a receptacle connector 604 are mounted. The electronic devices are not illustrated in the figure except the digital transmission chip 603.

On the subsidiary board 606 similarly provided with a conductor having a circuit pattern, the above-mentioned right-angle connector 800 and a receptacle connector 607 are mounted.

Those elements, such as the connectors and the electronic devices, mounted on the main board 602 and the subsidiary board 606 are fixed to and electrically connected thereto by soldering leads, pins, or lands of the elements to corresponding lands formed on these boards.

The main board 602 and the subsidiary board 606 are connected to each other through a FFC 605 having plug connectors formed at opposite ends thereof. For convenience of assembling and maintenance of the electronic apparatus 600, the plug connector at one end of the FFC 605 is adapted to be removably fitted to the receptacle connector 604 mounted on the main board 602. Similarly, the plug connector at the other end of the FFC 605 is adapted to be removably fitted to the receptacle connector 607 mounted on the subsidiary board 606.

However, in various arrangements using the conventional electrical connectors of the type, including the examples illustrated in FIGS. 1A, 1B, and 2, impedance mismatching is caused to occur at a portion where the connector and the subsidiary board are connected to each other. Furthermore, the conductors on the subsidiary board, including the circuit pattern and the lands, are susceptible to noise and produce a crosstalk. This results in a problem that a digital signal as a high-frequency signal transmitted between the digital transmission chip and the connector is seriously degraded.

In addition, the electronic apparatus is desired to be simplified in structure, reduced in size, decreased in weight, and lowered in cost. Accordingly, the arrangement including the electrical connector and used in the electronic apparatus is desired to be further simplified in structure, further reduced in size, further decreased in weight, and further lowered in cost.

SUMMARY OF THE INVENTION

It is therefore an object of this invention to provide an electrical connector capable of preventing degradation of a digital signal transmitted between a digital transmission chip and the connector.

It is another object of this invention to achieve simplification in structure, reduction in size, decrease in weight, and lowering in cost of an arrangement using the above-mentioned electrical connector.

Other objects of the present invention will become clear as the description proceeds.

According to an aspect of the present invention, there is provided an electrical connector for electrically connecting a first connection object and a second connection object through a plurality of contacts held by a housing. In the electrical connector, the housing comprises a front housing adapted to receive the first connection object and a rear housing coupled to the front housing in a first direction and adapted to receive the second connection object. The contacts have front contacting portions placed in the front housing and rear contacting portions placed in the rear housing. The contacts include a first signal contact, a second signal contact, a first ground contact, and a second ground contact. The front contacting portions of the fist signal contact and the first ground contact are arranged on a first row extending in a second direction perpendicular to the first direction. The front contacting portions of the second signal contact and the second ground contact are arranged on a second row which extends in the second direction and is spaced from the first row in a third direction perpendicular to the first and the second directions. The rear contacting portions of the first signal contact, the second signal contact, and the first ground contact are arranged on a third row extending in the second direction. The rear contacting portion of the second ground contact is arranged on a fourth row which extends in the second direction and is spaced from the third row in a third direction.

According to another aspect of the present invention, there is provided an electrical connector for electrically connecting a first connection object and a second connection object through a plurality of contacts held by a housing, the contacts including a plurality of pairs of first signal contacts, a plurality of pairs of second signal contacts, a plurality of first ground contacts, and a plurality of second ground contacts. Each of the first and the second signal contacts and the first and the second ground contacts have a first contacting portion to be contacted with a contact of the first connection object and a second contacting portion to be contacted with a contact of the second connection object. The housing comprises a front housing in which the first contacting portions are disposed and which is adapted to receive the first connection object and a rear housing in which the second contacting portions are disposed and which is adapted to receive the second connection object. The first contacting portions of the pair of first signal contacts and the first contacting portion of the first ground contact are alternatively arranged in parallel in a first row extending in a widthwise direction perpendicular to an insert/remove direction of the first connection object. The first contacting portions of the pair of second signal contacts and the first contacting portion of the second ground contact are alternatively arranged in parallel in a second row extending in the widthwise direction. The first contacting portions of the pair of first signal contacts in the first row are faced to the first contacting portion of the second ground contact in the second row in a vertical direction perpendicular to the insert/remove direction of the first connection object and the widthwise direction. The first contacting portions of the pair of second signal contacts in the second row are faced to the first contacting portion of the first ground contact in the first row in the vertical direction. The second contacting portions of the pair of first signal contacts, the second contacting portion of the first ground contact, the second contacting portions of the pair of second signal contacts, and the second contacting portion of the other first ground contact are arranged in parallel in this order in a third row extending in the widthwise direction. The second contacting portions of the second ground contacts are arranged in parallel in a fourth row extending in the widthwise direction. The second contacting portions of the pair of first signal contacts and the second contacting portions of the pair of second signal contacts in the third row are faced to the second contacting portions of the second ground contacts in the fourth row in the vertical direction.

DESCRIPTION OF THE PREFERRED EMBODIMENT

Figure 1A:
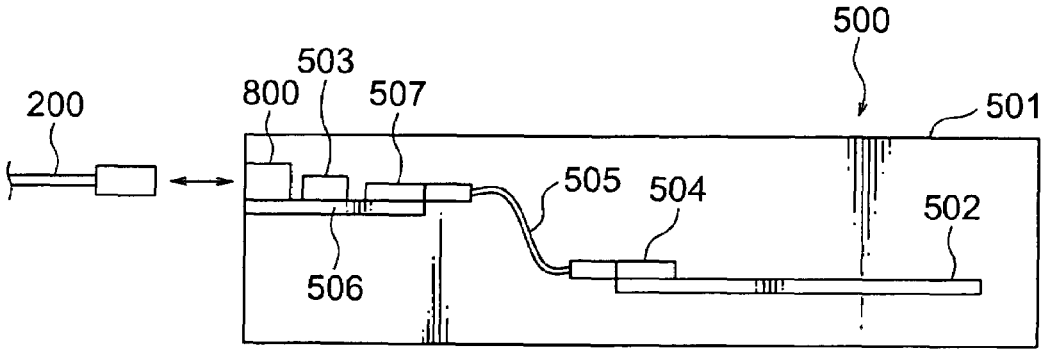
FIG. 1A PRIOR ART
FIGS. 1A and 1B are schematic views showing electronic apparatuses using conventional electrical connectors.
Figure 1B:
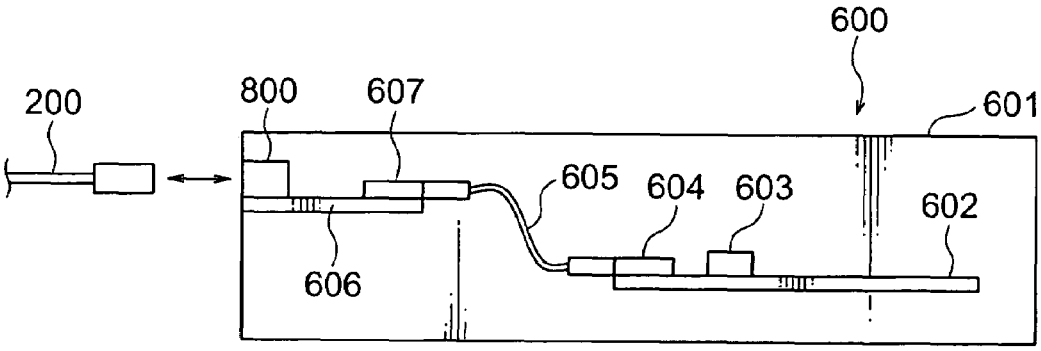
FIG. 1B PRIOR ART
Figure 2:
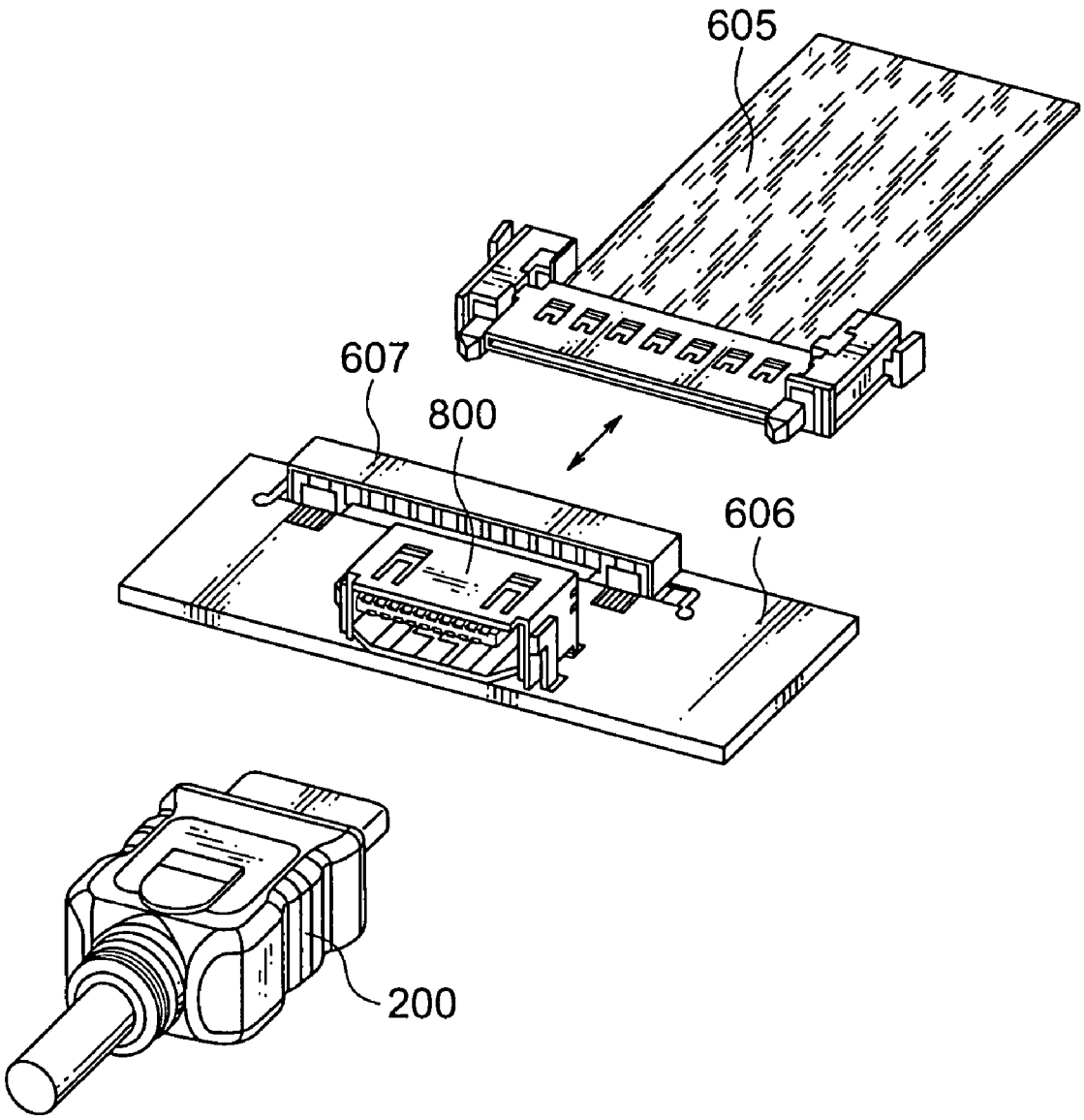
FIG. 2 PRIOR ART
FIG. 2 is a perspective view of a characteristic part in FIG. 1B.

Now, an electrical connector according to an embodiment of this invention will be described with reference to the drawing.

Figure 3:
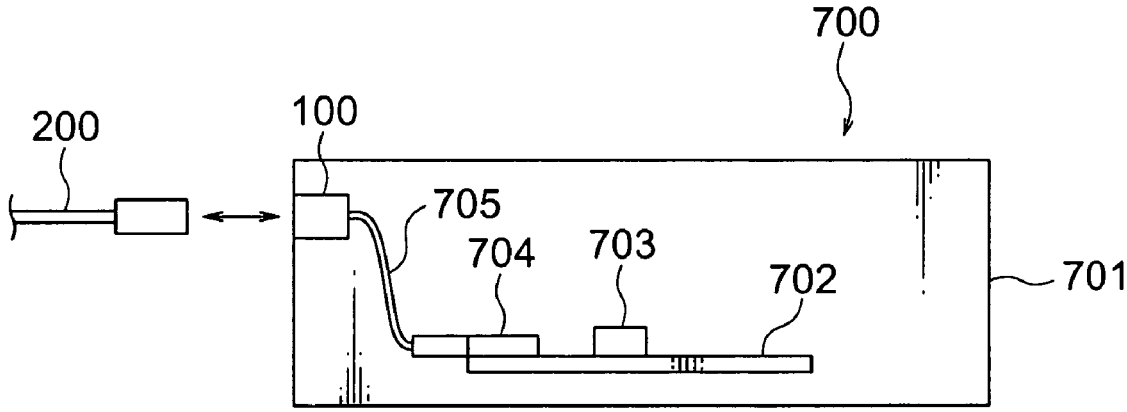
FIG. 3 is a schematic view showing an electronic apparatus using an electrical connector according to an embodiment of this invention.
Figure 4A:
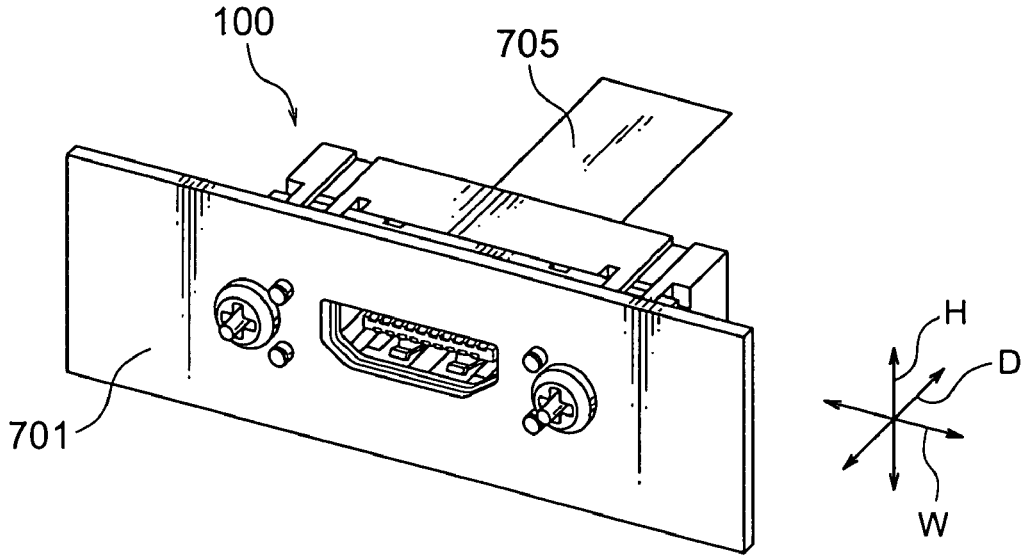
FIGS. 4A and 4B are a front perspective view and a rear perspective view of the electrical connector illustrated in FIG. 3, respectively, in a state where it is attached to a casing of the electronic apparatus.
Figure 4B:
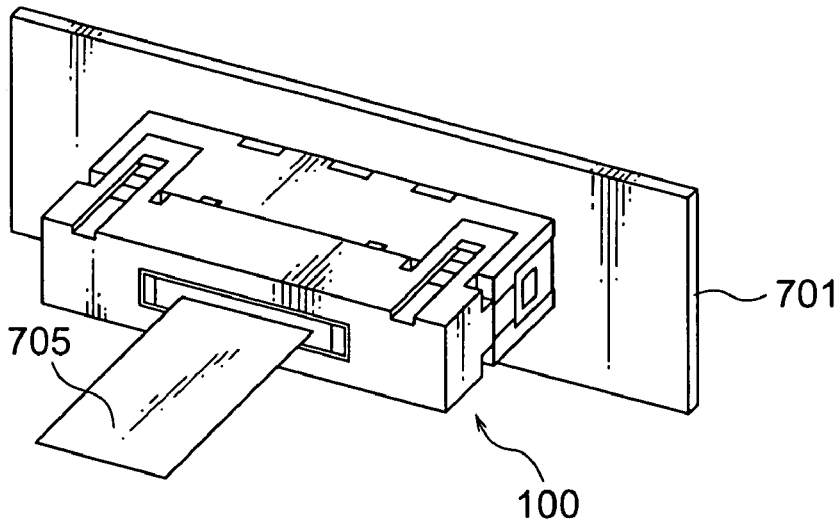

Referring to FIG. 3, the electrical connector depicted at 100 is a receptacle connector according to the HDMI standard and is mounted to a digital electronic apparatus 700 such as an optical disk recorder. The electrical connector 100 serves to connect a peripheral apparatus (not shown) such as a digital display, an associated apparatus (not shown) such as a set-top box (STB) for cable television broadcasting, or the like to the digital electronic apparatus 700 through a plug harness 200 according to the HDMI standard. The electrical connector 100 is attached to a rear panel of a casing 701 of the digital electronic apparatus 700 by the use of screws.

The electronic apparatus 700 comprises the casing 701 and a main board 702 disposed inside the casing 701. On the main board 702, a receptacle connector 704 and various electronic devices forming an electronic circuit and including a CPU and a digital transmission chip 703 are mounted. The electronic devices are not illustrated in the figure except the digital transmission chip 703. The digital transmission chip 703 serves to perform bidirectional conversion between a signal according to a standard processed by the electronic circuit formed on the main board 702 and a signal according to the HDMI standard. Those elements, such as the connectors and the electronic devices, mounted on the main board 702 are fixed to and electrically connected to the main board 702 by soldering leads, pins, or lands of the elements to corresponding lands formed on the main board 702. A FFC 705 is connected to the main board 702.

Figure 5:
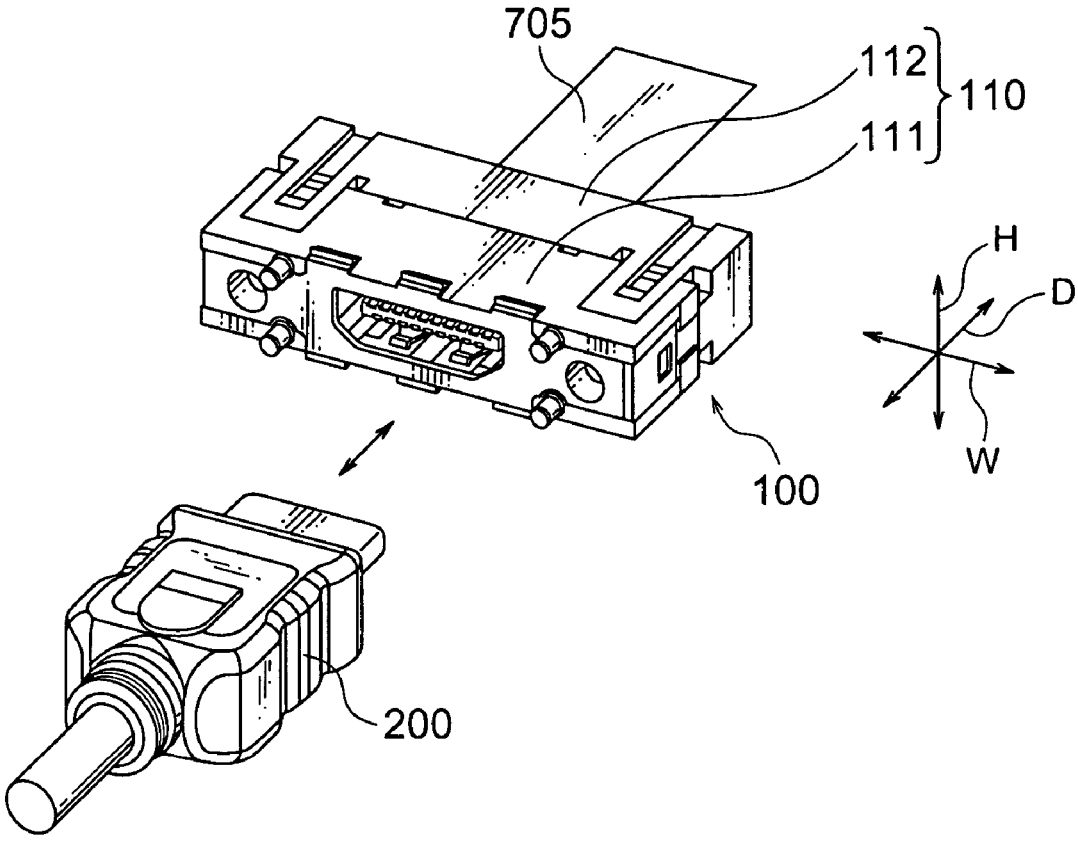
FIG. 5 is a perspective view of the electrical connector and a plug harness.

Referring to FIGS. 3, 4A, 4B, and 5, the electrical connector 100 comprises a housing 110 and electrically connects the HDMI plug harness 200 (first connection object) and the FFC 705 (second connection object) via a plurality of contacts (not shown) held by the housing 110 without using another board. The HDMI plug harness 200 serves to connect the digital electronic apparatus 700 to the peripheral apparatus or the like. In FIG. 5, the rear panel of the casing 701 is not illustrated.

Specifically, the electrical connector 100 and the main board 702 with the digital transmission chip 703 mounted thereto are connected to each other via the FFC 705 having one end provided with a plug connector and the other end provided with a housing 751 (shown in FIG. 7). For convenience of assembling and maintenance of the electronic apparatus 700, the plug connector connected to the one end of the FFC 705 is adapted to be removably fitted to the receptacle connector 704 mounted on the main board 702. On the other hand, the other end of the FFC 705 provided with the housing 751 is adapted to be removably fitted to the connector 100.

With the above-mentioned structure, the electrical connector according to this invention is connected, without using a subsidiary board, to the FFC as connecting means to the digital transmission chip for bidirectional conversion between the signal according to the standard processed by the electronic circuit formed on the main board and the signal according to the HDMI standard. Therefore, it is possible to avoid the above-mentioned problems in the arrangements using the conventional electrical connectors, i.e., impedance mismatching at a junction of the electrical connector and the subsidiary board, occurrence of noise or crosstalk at the conductors such as a circuit pattern and lands on the subsidiary board. Therefore, it is possible to effectively suppress degradation of a digital signal as a high-frequency signal transmitted between the digital transmission chip and the connector.

The electrical connector according to this invention is used without a subsidiary board. Therefore, the electrical connector is simple in structure, small in size, light in weight, and low in production cost and assembling cost and, therefore, contributes to simplification in structure, reduction in size, decrease in weight, and lowering in cost of the electronic apparatus using the electrical connector.

This invention is advantageous not only in that the subsidiary board is not used. That is, by the shape and the layout of the contacts unique to this invention, pin assignment is converted between first contacting portions adapted to be connected with the plug connector as the first connection object and second contacting portions adapted to be connected with the flexible flat cable as the second connection object so as to optimize an arrangement of ground contacts with respect to signal contacts, thereby achieving a higher shielding effect. Such unique pin assignment conversion in addition to non-use of the subsidiary board prevents degradation of a digital signal in a high-frequency band even after transmission through the electrical connector.

Referring to FIGS. 3, 4A, 4B, 5, 6A to 6D, and 7A to 7C, the electrical connector according to the embodiment of this invention will be described more in detail.

The housing 110 is adapted to receive the plug harness 200 and the housing 751 attached to the other end of the FFC 705 so that each of the plug harness 200 and the housing 751 is removably inserted in the insert/remove direction D. To the housing 751, a metal shell 752 is attached. The metal shell 752 has three contacting elements to be contacted to a solid ground conductor layer 753 thickly formed on or adhered to all over an upper surface of the FFC 705.

Figure 7B:
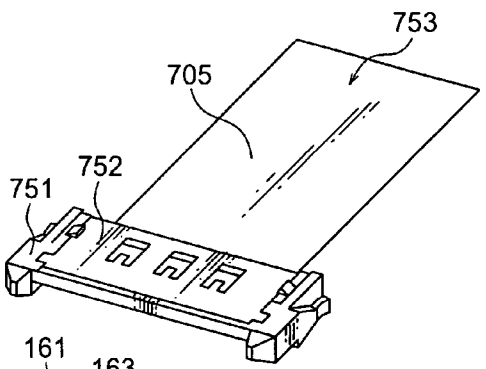
FIG. 7B is an enlarged perspective view of a flexible flat cable illustrated in FIG. 7A.
Figure 7B:
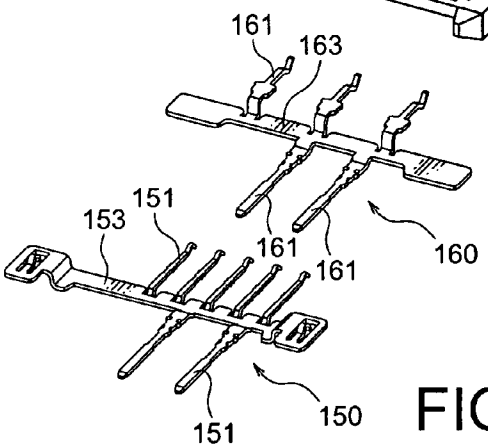
Figure 7C:
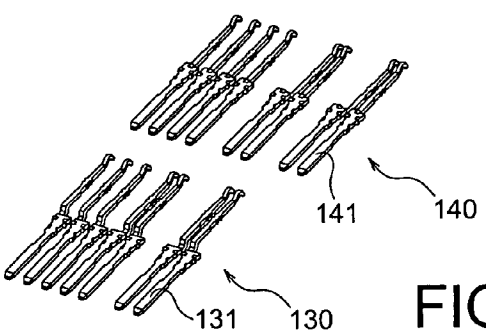
FIG. 7C is an enlarged perspective view of contacts and contact groups illustrated in FIG. 7A.
Figure 7A:
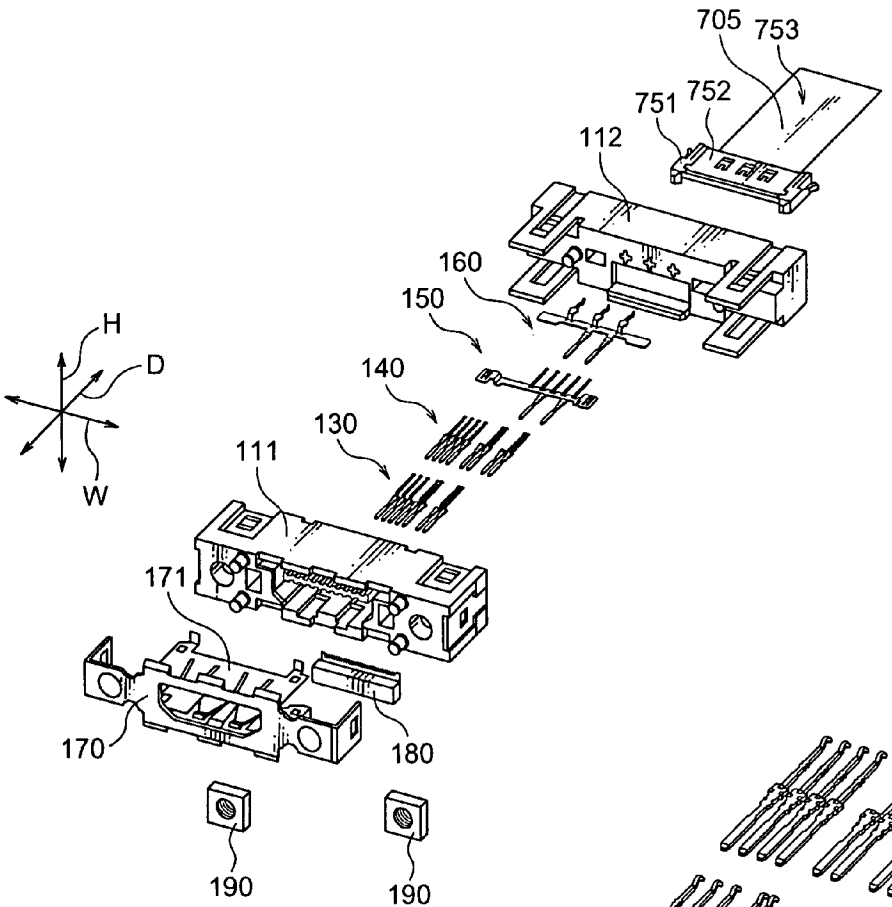
FIG. 7A is an exploded perspective view of the electrical connector illustrated in FIG. 5.
Figure 8:
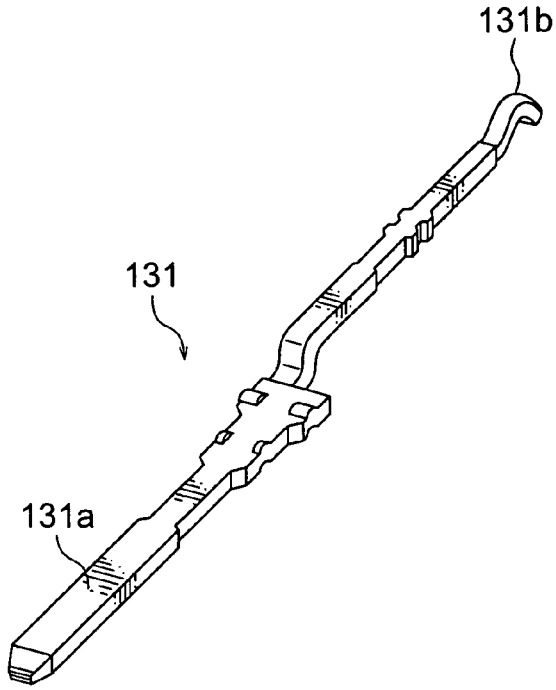
FIG. 8 is a perspective view of one of the contacts illustrated in FIG. 7C.
Figure 9:
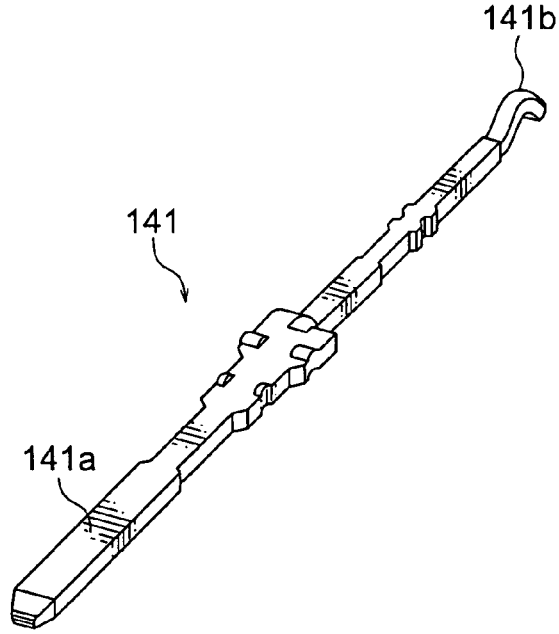
FIG. 9 is a perspective view of another contact illustrated in FIG. 7C.

The electrical connector 100 comprises, as the contacts, a plurality of first signal contacts 131 and 132, a plurality of second signal contacts 141 and 142, a first ground contact 151, and a second ground contact 161. The first signal contacts 131 include two types of contacts different in shape although only one type is illustrated in FIG. 8 which will later be referred to. Similarly, the second signal contacts 141 include two types of contacts different in shape although only one type is illustrated in FIG. 9 which will later be referred to. In FIGS. 7A and 7C, reference numerals 130, 140, 150, and 160 represent a first signal contact group comprising the first signal contacts 131, a second signal contact group comprising the second signal contacts 141, a first ground contact group comprising the first ground contact 151, and a second ground contact group comprising the second ground contact 161.

As shown in FIG. 8, each of the first signal contacts 131 has a first contacting portion 131*a* to be contacted with a corresponding contact (not shown) of the plug harness 200 and a second contacting portion 131*b* to be contacted with a conductor (not shown) formed on a lower surface of the FFC 705 to transmit a signal. Similarly, as shown in FIG. 7C, each of the first signal contacts 132 has a first contacting portion 132*a* to be contacted with a corresponding contact (not shown) of the plug harness 200 and a second contacting portion 132*b* to be contacted with the conductor (not shown) formed on the lower surface of the FFC 705 to transmit a signal.

As shown in FIG. 9, each of the second signal contacts 141 has a first contacting portion 141*a* to be contacted with a corresponding contact (not shown) of the plug harness 200 and a second contacting portion 141*b* to be contacted with a conductor (not shown) formed on the lower surface of the FFC 705 to transmit a signal. Similarly, as shown in FIG. 7C, each of the second signal contacts 142 has a first contacting portion 142*a* to be contacted with a corresponding contact (not shown) of the plug harness 200 and a second contacting portion 142*b* to be contacted with the conductor (not shown) formed on the lower surface of the FFC 705 to transmit a signal.

Figure 10:
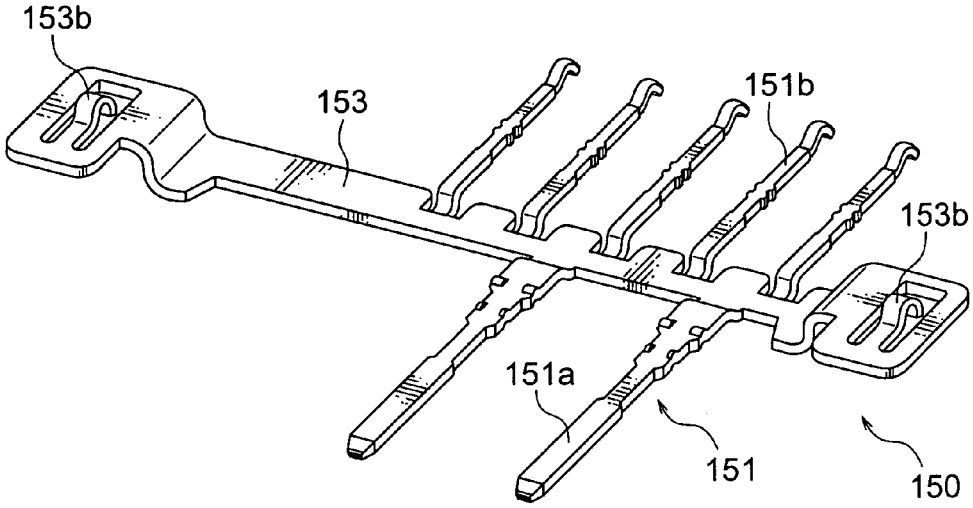
FIG. 10 is a perspective view of one of the contact groups illustrated in FIG. 7C.

As shown in FIG. 10, the first ground contact 151 has at least one first contacting portion 151*a* to be contacted with a corresponding contact of the plug harness 200 and at least one second contacting portion 151*b* to be contacted with a ground conductor formed on the lower surface of the FFC 705. It is noted here that the first contacting portions 151*a* and the second contacting portions 151*b* may be not in one-to-one correspondence. In the illustrated example, the number of the first contacting portions 151*a* is equal to two while the number of the second contacting portions 151*b* is equal to five.

Figure 11:
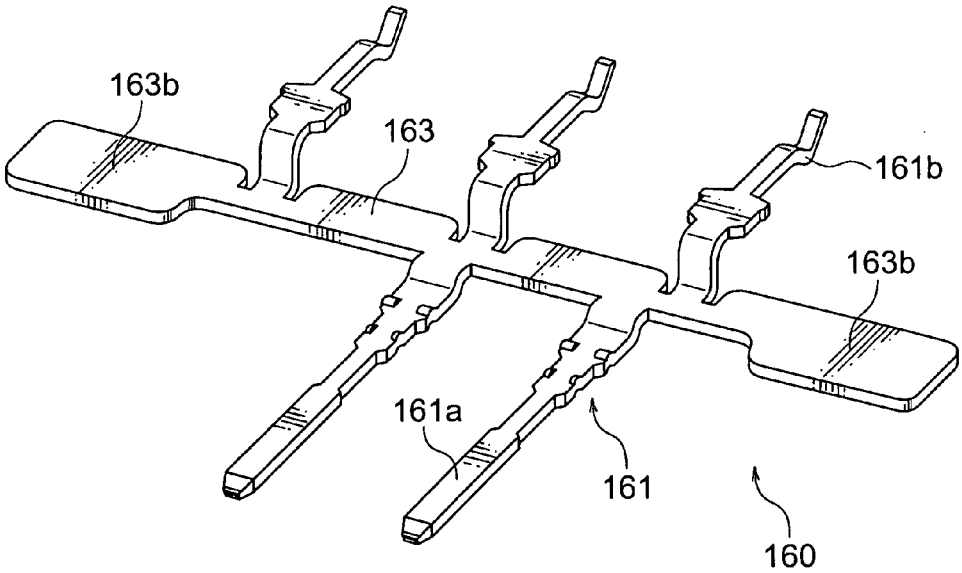
FIG. 11 is a perspective view of another contact group illustrated in FIG. 7C.

As shown in FIG. 11, the second ground contact 161 has at least one first contacting portion 161*a* to be contacted with a corresponding contact of the plug harness 200 and at least one second contacting portion 161*b* to be contacted with the metal shell 752 kept in contact with the solid ground conductor layer 753 of the FFC 705. It is noted here that the first contacting portions 161*a* and the second contacting portions 161*b* may be not in one-to-one correspondence. In the illustrated example, the number of the first contacting portions 161*a* is equal to two while the number of the second contacting portions 161*b* is equal to three.

The housing 110 comprises a front housing 111, a rear housing 112 coupled to the front housing 111 in an insert/remove direction (depth direction or first direction) D, and a middle insulator 180.

The front housing 111 accommodates the first contacting portions 131*a* of the first signal contacts 131, the first contacting portions 141*a* of the second signal contacts 141, the first contacting portions 151*a* of the first ground contacts 151, and the first contacting portions 161*a* of the second ground contacts 161 and is adapted to be fitted to the plug harness 200.

The rear housing 112 accommodates the second contacting portions 131*b* of the first signal contacts 131, the second contacting portions 141*b* of the second signal contacts 141, the second contacting portions 151*b* of the first ground contacts 151, and the second contacting portions 161*b* of the second ground contacts 161 and is adapted to be fitted to the housing 751 attached to the other end of the FFC 705.

The front housing 111 and the rear housing 112 are separably coupled by engagement between four wedge-like protrusions formed on the front housing 111 and four elastic members with a rectangular hole formed on the rear housing 112.

Figure 14:
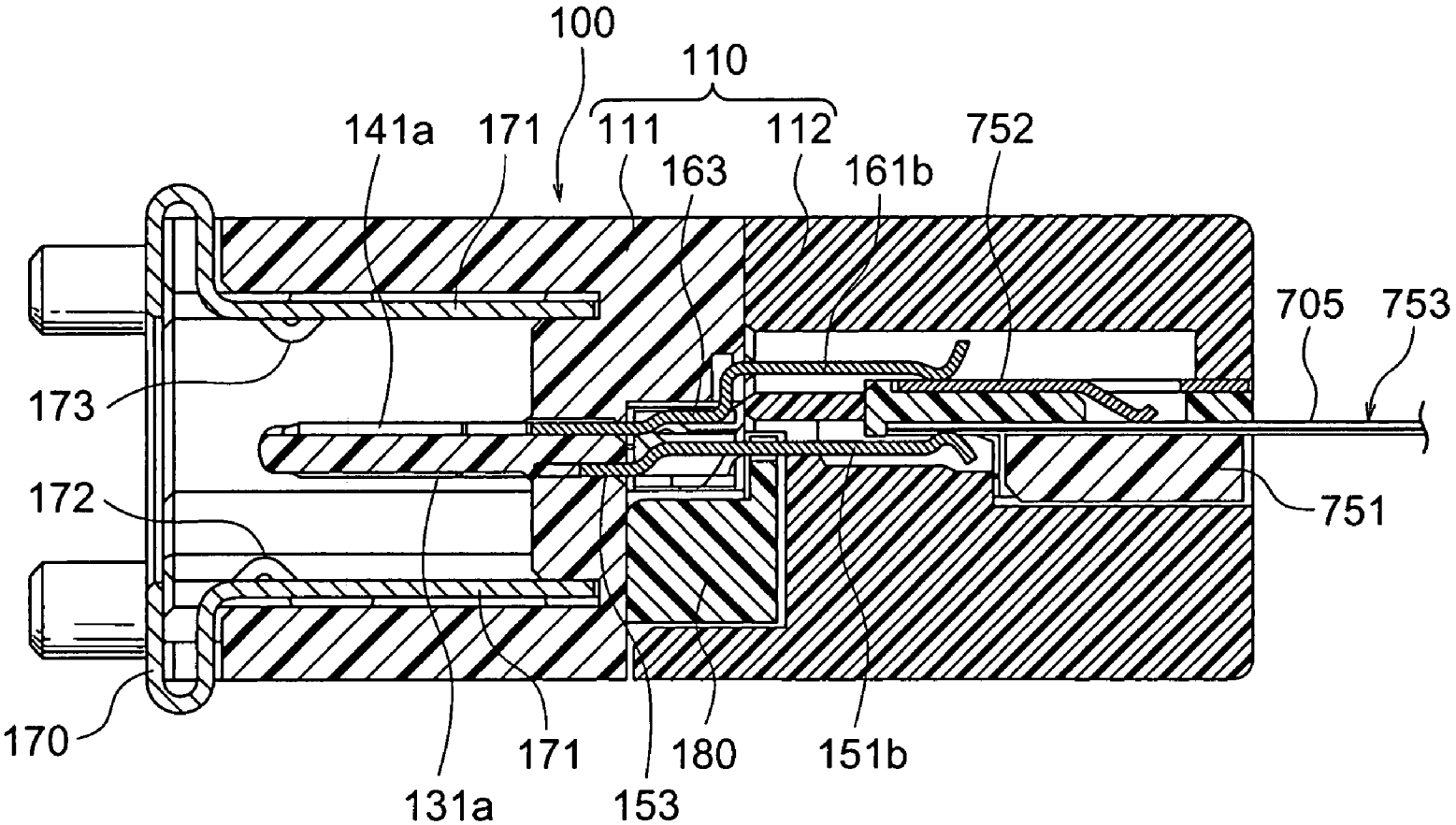
FIG. 14 is a sectional view taken along a line 14-14 in FIG. 6A.

As shown in FIG. 14, the middle insulator 180 is fitted to a recess formed on a lower surface of the front housing 111 and fixed by the rear housing 112 when the front housing 111 and the rear housing 112 are coupled to each other. The middle insulator 180 has a comb-like portion formed on its upper surface to extend in a widthwise direction (second direction) W of the electrical connector. The comb-like portion serves to hold the second contacting portions 131*b* and 141*b* of the first and the second signal contacts 131 and 141 and the second contacting portions 151*b* of the first ground contacts 151 at predetermined positions.

Referring to FIG. 7A, a pair of nuts 190 are fitted to a pair of recesses (not shown) formed on the lower surface of the front housing 111 and are fixed by the rear housing 112 when the front housing 111 and the rear housing 112 are coupled to each other. The nuts 190 serve as female threads when the connector 100 is fixed to an inner surface of the rear panel of the casing 701 of the digital electronic apparatus 700 by the use of the screws inserted from the outside of the rear panel of the casing 701.

In this invention, the subsidiary board is not used. In addition, by the shape and the layout of the contacts unique to this invention, pin assignment is converted between the first contacting portions adapted to be contacted with the plug connector as the first connection object and the second contacting portions adapted to be contacted with the flexible flat cable as the second connection object. Thus, an arrangement of the ground contacts with respect to the signal contacts is optimized to achieve a higher shielding effect. Therefore, such unique pin assignment conversion prevents degradation of a digital signal in a high-frequency band even after transmission through the electrical connector. The pin assignment conversion will be described below with reference to the drawing.

Figure 6A:
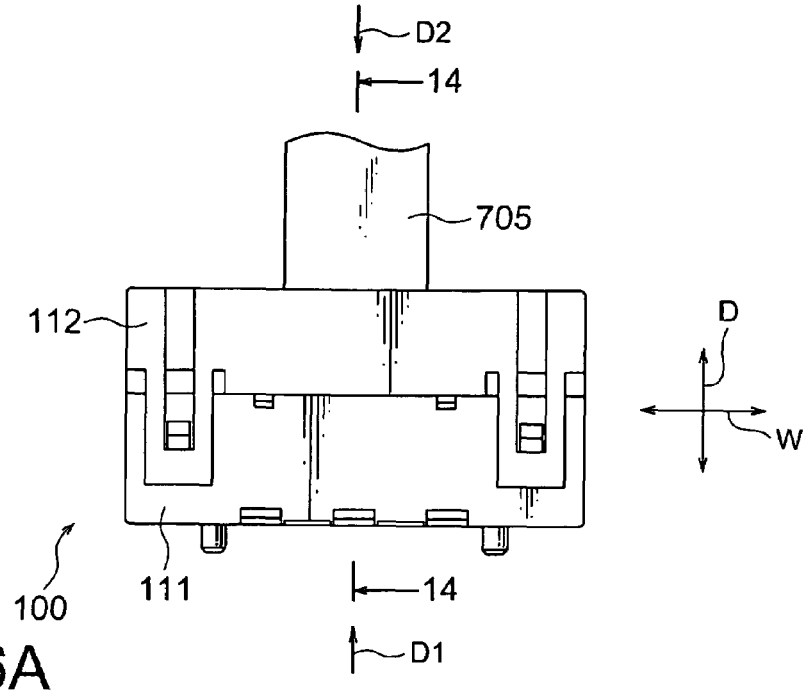
FIGS. 6A, 6B, 6C, and 6D are a plan view, a front view, a right side view, and a rear side view of the electrical connector illustrated in FIG. 5.
Figure 6B:
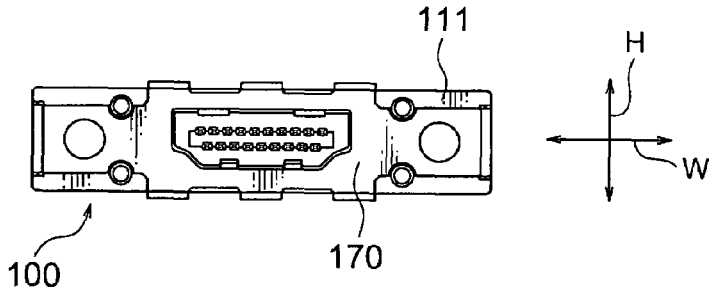
Figure 6C:
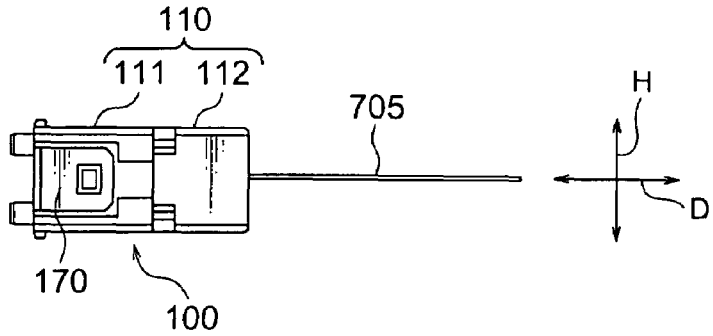
Figure 6D:
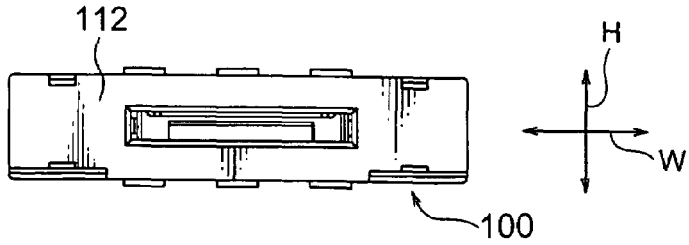
Figure 12:
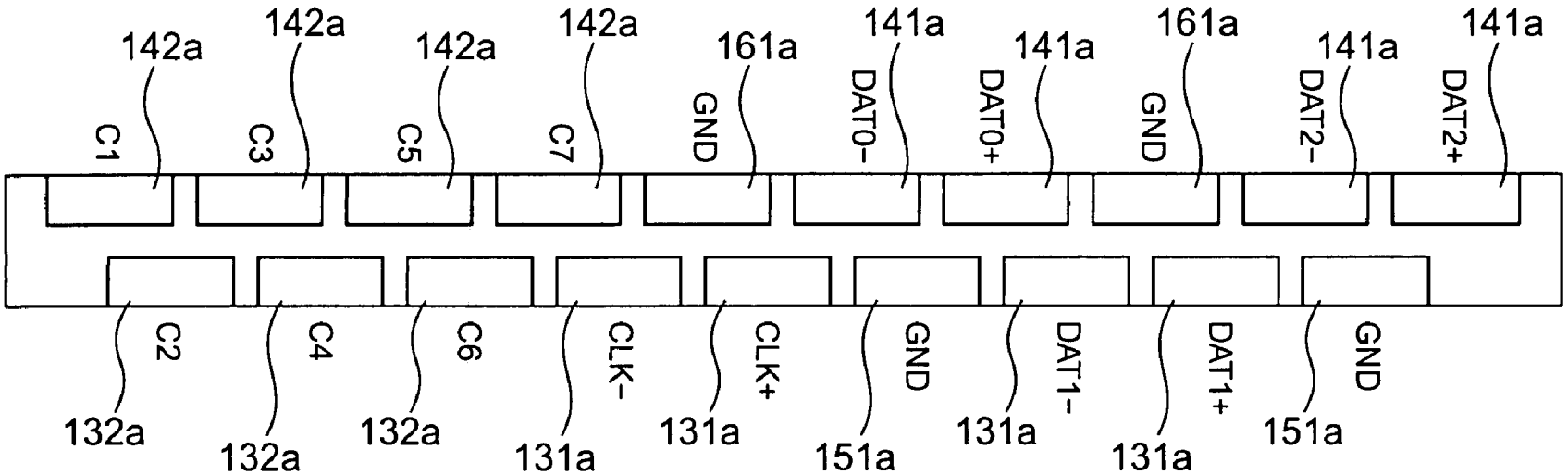
FIG. 12 is a partial front view for describing a layout of the contacts in the electrical connector illustrated in FIG. 5.

Referring to FIGS. 12 and 14, description will be made of a layout of the contacts as seen in a direction D1 in FIG. 6A, i.e., a layout of the first contacting portions of the contacts. The pin assignment of the first contacting portions is defined by the HDMI standard corresponding to digital signal transmission in a high-frequency band. On the side of the first contacting portions, nine contacts (pins) and ten contacts (pins) are arranged in parallel in a lower row as a first row and an upper row as a second row in a vertical direction (height direction or third direction) H of the electrical connector, respectively.

The contacts serve as GND (ground) pins, DAT (DAT) pins, CLK (clock) pins, and C1 to C7 pins. The DAT pins include a pair of DAT0− and DAT0+ pins, a pair of DAT1− and DAT1− pins, and a pair of DAT2− and DAT2+ pins for differential signal pairs.

Among those, the C1 to C7 pins are idle pins or signal pins for those signals which are not required to have so strict impedance matching as the differential signal pairs transmitted through the CLK pins and the DAT pins which will later be described. The remaining pins except the C1 to C7 pins are arranged in the following manner.

In the lower row, the first contacting portions 131*a* of the first signal contacts 131 (CLK− and CLK+), the first contacting portion 151*a* of the first ground contact 151 (GND), the first contacting portions 131*a* of the first signal contacts 131 (DAT1− and DAT1+), and the first contacting portion 151*a* of the first ground contact 151 (GND) are arranged in parallel in this order in the widthwise direction of the electrical connector.

On the other hand, in the upper row, the first contacting portion 161*a* of the second ground contact 161 (GND), the first contacting portions 141*a* of the second signal contacts 141 (DAT0− and DAT0+), the first contacting portion 161*a* of the second ground contact 161 (GND), and the first contacting portions 141*a* of the second signal contacts 141 (DAT2− and DAT2+) are arranged in parallel in this order in the widthwise direction of the electrical connector.

The first contacting portions 131*a* of the first signal contacts 131 (CLK− and CLK+) face the first contacting portion 161*a* of the second ground contact 161 (GND) in the vertical direction of the electrical connector. The first contacting portions 131*a* of the first signal contacts 131 (DAT1− and DAT1+) face the first contacting portion 161*a* of the second ground contact 161 (GND) in the vertical direction of the electrical connector. The first contacting portions 141*a* of the second signal contacts 141 (DAT0− and DAT0+) face the first contacting portion 151*a* of the first ground contact 151 (GND) in the vertical direction of the electrical connector. The first contacting portions 141*a* of the second signal contacts 141 (DAT2− and DAT2+) face the first contacting portion 151*a* of the first ground contact 151 (GND) in the vertical direction of the electrical connector.

Thus, in the pin assignment according to the HDMI standard, the GND pins are faced to the CLK pins and the DAT pins (DAT0 to DAT2) for the differential signal pairs required to achieve strict impedance matching.

Figure 13:
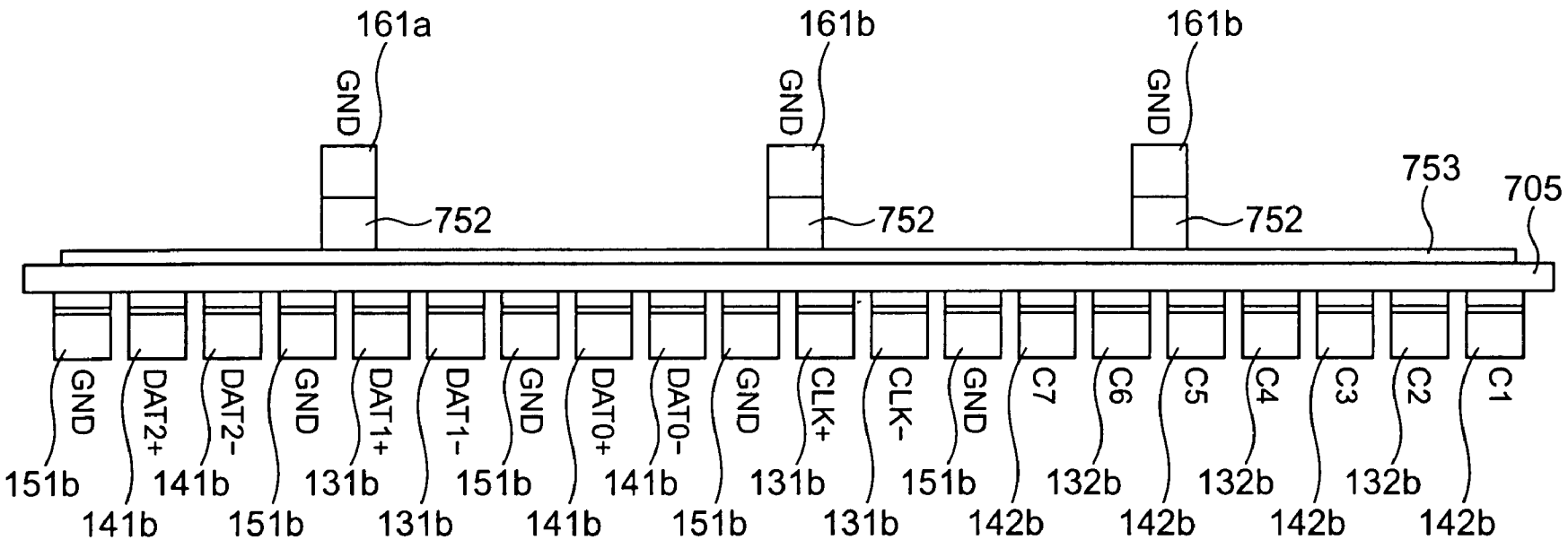
FIG. 13 is a partial rear view for describing the layout of the contacts in the electrical connector illustrated in FIG. 5.

Referring to FIGS. 13 and 14, description will be made of a layout of the contacts as seen in a direction D2 in FIG. 6A, i.e., a layout of the second contacting portions of the contacts as the pin assignment unique to this invention. On the side of the second contacting portions, twenty contacts (pins) and three contacts (pins) are arranged in parallel in a lower row as a third row and an upper row as a fourth row in the vertical direction of the electrical connector.

The remaining pins except the above-mentioned C1 to C7 pins as the signal pins or the idle pins are arranged in the following manner. In the lower row, the second contacting portion 151*b* of the first ground contact 151 (GND), the second contacting portions 131*b* of the first signal contacts 131 (CLK− and CLK+), the second contacting portion 151*b* of the first ground contact 151 (GND), the second contacting portions 141*b* of the second signal contacts 141 (DAT0− and DAT0+), the second contacting portion 151*b* of the first ground contact 151 (GND), the second contacting portions 131*b* of the first signal contacts 131 (DAT1− and DAT1+), the second contacting portion 151*b* of the first ground contact 151 (GND), the second contacting portions 141*b* of the second signal contacts 141 (DAT2− and DAT2+), and the second contacting portion 151*b* of the first ground contact 151 (GND) are arranged in parallel in this order in the widthwise direction of the electrical connector.

In the upper row, the second contacting portions 161*b* of the second ground contacts 161 (GND), three in number, are arranged in parallel in the widthwise direction of the electrical connector.

The second contacting portions 131*b* of the first signal contacts 131 (CLK− and CLK+), the second contacting portions 141*b* of the second signal contacts 141 (DAT0− and DAT0+), the second contacting portions 131*b* of the first signal contacts 131 (DAT1+ and DAT1−), the second contacting portions 141*b* of the second signal contacts 141 (DAT2− and DAT2+) are faced to the second contacting portions 161*b* of the second ground contacts 161 (GND) through the solid ground conductor layer 753 on the FFC 705 and the metal shell 752 in the vertical direction of the electrical connector.

With the above-mentioned structure, crosstalk among the CLK pins, the DAT0 pins, the DAT1 pins, and the DAT2 pins is decreased.

In the widthwise direction of the electrical connector, the first signal contacts 131 as the CLK pins and the DAT1 pins for the differential pairs are formed so that the second contacting portions 131*b* are narrower than the first contacting portions 131*a* and that the second contacting portions 131*b* in each pair are offset towards each other. As a result, the pitch (for example, 0.5 mm) between the second contacting portions 131*b* is narrower than that (for example, 1 mm) between the first contacting portions 131*a*. Similarly, in the widthwise direction of the electrical connector, the second signal contacts 141 as the DAT0 pins and the DAT1 pins for the differential signal pairs are formed so that the second contacting portions 141*b* are narrower than the first contacting portions 141*a* and that the second contacting portions 141*b* in each pair are offset towards each other. As a result, the pitch (for example, 0.5 mm) between the second contacting portions 141*b* is narrower than that (for example, 1 mm) between the first contacting portions 141*a*.

On the other hand, in the first ground contact group 150, the first ground contacts 151 are connected at an intermediate position between the first and the second contacting portions 151*a* and 151*b* through a connecting portion 153 extending in the widthwise direction of the electrical connector. Herein, the first contacting portions 151*a*, two in number, are connected to the second contacting portions 151*b*, five in number. In the widthwise direction of the electrical connector, the pitch (for example, 1.5 mm) between the second contacting portions 151*b* is narrower than that (for example, 3 mm) between the first contacting portions 151*a*.

In other words, in the above-mentioned electrical connector 100, the first contacting portions of the contacts have the pitch of 1 mm as defined by the HDMI standard. On the other hand, the second contacting portions of the contacts have the pitch of 0.5 mm. Thus, in this electrical connector 100, the pitch of the contacts can be converted without using the subsidiary board.

In the second ground contact group 160, the second ground contacts 161 are connected at an intermediate position between the first and the second contacting portions 161*a* and 161*b* through a connecting portion 163 extending in the widthwise direction of the electrical connector.

The connecting portion 153 of the first ground contact group 150 is provided with a pair of contacting elements 153*b*. On the other hand, the connecting portion 163 of the second ground contact group 160 is provided with a pair of flat portions 163*b*. When the contacts are incorporated into the housing 110, the contacting elements 153*b* are brought into contact with the flat portions 163*b*. As a result, the first and the second ground contact groups 150 and 160 are electrically connected to each other.

With the above-mentioned structure, all of the ground contacts are used in common as a ground for the differential signal pairs to thereby improve stability in signal transmission.

The electrical connector 100 has a metal shell 170 attached to a front surface of the housing 110 adapted to receive the plug harness 200 removably inserted thereinto. The metal shell 170 has extending portions 171 extending inward of the front housing 111 to face at least a part of each of the first contacting portions 131*a* and 141*a* of the first and the second signal contacts 131 and 141, and contacting elements 172 and 173 adapted to be contacted with a ground portion of the plug harness 200.

With the above-mentioned structure, when the plug harness 200 is connected to the electrical connector 100, ground connection is achieved between the electronic apparatus 700 and the peripheral apparatus or the associated apparatus and a common ground connection is obtained. Thus, as a system including the plug harness 200, the shielding effect is improved and noise protection is advantageously achieved.

Next, description will be made of modifications of the electrical connector according to the embodiment of this invention.

Figure 15:
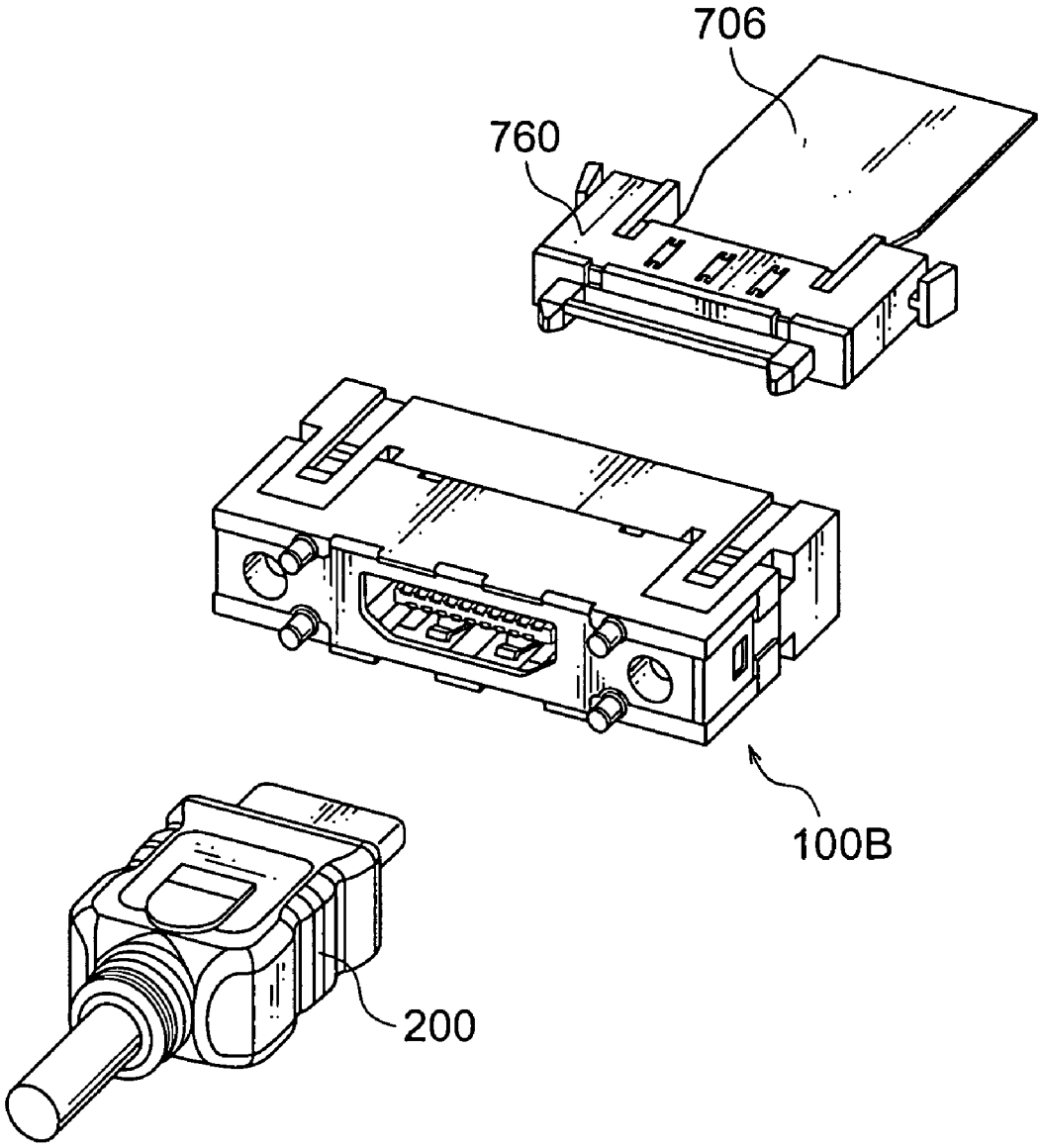
FIG. 15 is a perspective view of an electrical connector according to a first modification of the embodiment of this invention.

Referring to FIG. 15, a connector 100B according to a first modification serves to connect a plug harness 200 according to the HDMI standard and a FFC 706 connected to a main board with a digital transmission chip mounted thereto. The plug harness 200 and the FFC 706 are connected by contacts held by a housing without using another board (subsidiary board). The connector 100B is attached to a rear panel of a casing of the digital electronic apparatus by the use of screws. The housing of the connector 100B is formed so that each of the plug harness 200 and a FFC plug connector 760 connected to the other end of the FFC 706 can be inserted and removed in the insert/remove direction D.

Figure 16A:
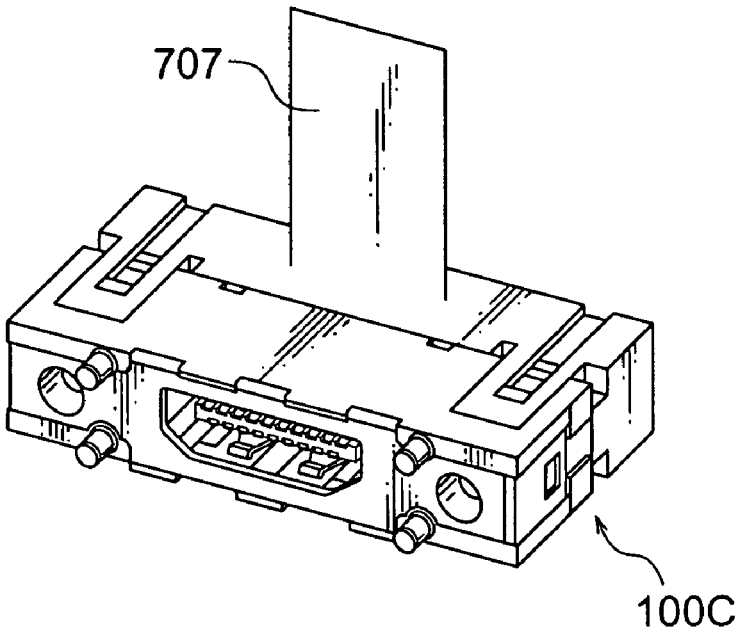
FIGS. 16A and 16B are perspective views of electrical connectors according to second and third modifications of the embodiment of this invention, respectively.

Referring to FIG. 16A, a connector 100C according to a second modification serves to connect a plug harness according to the HDMI standard and a FFC 707 connected to a main board with a digital transmission chip mounted thereto. The plug harness and the FFC 707 are connected by contacts held by a housing without using another board (subsidiary board). The connector 100C is attached to a rear panel of a casing of the digital electronic apparatus by the use of screws. In this modification, the FFC 707 is inserted through an upper surface of the housing of the connector 100C in the vertical direction of the electrical connector perpendicular to the insert/remove direction D.

Figure 16B:
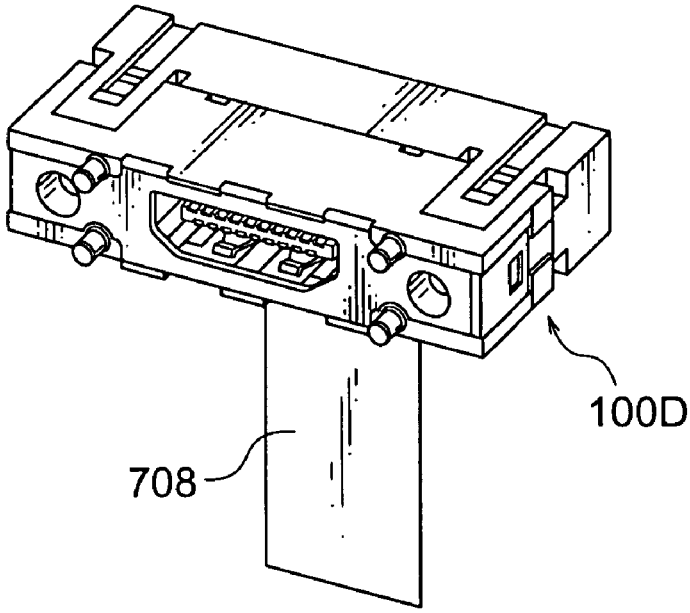

Referring to FIG. 16B, a connector 100D according to a third modification serves to connect a plug harness according to the HDMI standard and a FFC 708 connected to a main board with a digital transmission chip mounted thereto. The plug harness and the FFC 708 are connected by contacts held by a housing without using another board (subsidiary board). The connector 100D is attached to a rear panel of a casing of the digital electronic apparatus by the use of screws. In this modification, the FFC 708 is inserted through a lower surface of the housing of the connector 100D in the vertical direction of the electrical connector perpendicular to the insert/remove direction D.

This invention is applicable also to an electrical connector with a FFC, i.e., an electrical connector having the above-mentioned structure and further provided with a FFC.

Although this invention has been described in conjunction with a few preferred embodiments thereof, this invention may be modified in various other manners within the scope of this invention. For example, this invention is applicable not only to a connector according to the HDMI standard but also to a connector according to any other standard.

What is claimed is:

1. An electrical connector for electrically connecting a first connection object and a second connection object through a plurality of contacts held by a housing, wherein:

the housing comprises a front housing adapted to receive the first connection object and a rear housing coupled to the front housing in a first direction and adapted to receive the second connection object;

the contacts have front contacting portions placed in the front housing and rear contacting portions placed in the rear housing and include a first signal contact, a second signal contact, a first ground contact, and a second ground contact;

the front contacting portions of the first signal contact and the first ground contact are arranged on a first row extending in a second direction perpendicular to the first direction;

the front contacting portions of the second signal contact and the second ground contact are arranged on a second row which extends in the second direction and is spaced from the first row in a third direction perpendicular to the first and the second directions;

the rear contacting portions of the first signal contact, the second signal contact, and the first ground contact are arranged on a third row extending in the second direction; and the rear contacting portion of the second ground contact is arranged on a fourth row which extends in the second direction and is spaced from the third row in the third direction, so as to contact to a solid ground conductor layer thickly formed on a surface of the second connection object; and the rear contacting portions of the first signal contacts and the rear contacting portions of the second signal contacts are faced to the rear contacting portions of the second ground contacts through the solid ground conductor layer in the third direction.

2. The electrical connector according to claim 1, wherein the front and the rear housings can be decoupled from to each other in the predetermined direction.

3. The electrical connector according to claim 1, wherein:

the first ground contact includes a connecting portion extending in the second direction; and the front and the rear contacting portions of the first ground contact are displaced from to each other in the second direction and connected to the connecting portion.

4. The electrical connector according to claim 1, wherein:

the second ground contact includes a connecting portion extending in the second direction; and the front and the rear contacting portions of the second ground contact are displaced from to each other in the second direction and connected to the connecting portion.

5. The electrical connector according to claim 1, wherein:

the first ground contact includes a first connecting portion extending in the second direction;

the front and the rear contacting portions of the first ground contact are displaced from to each other in the second direction and connected to the first connecting portion;

the second ground contact includes a second connecting portion extending in the second direction; and the front and the rear contacting portions of the second ground contact are connected to the second connecting portion and displaced from to each other in the second direction.

6. The electrical connector according to claim 1, further comprising a metal shell, the front housing having a fitting portion for fitting over the first connection object, the metal shell having an extending portion extending in the fitting portion to face the front contacting portions.

7. An electrical connector for electrically connecting a first connection object and a second connection object through a plurality of contacts held by a housing;

the contacts including a plurality of pairs of first signal contacts, a plurality of pairs of second signal contacts, a plurality of first ground contacts, and a plurality of second ground contacts;

each of the first and the second signal contacts and the first and the second ground contacts having a first contacting portion to be contacted with a contact of the first connection object and a second contacting portion to be contacted with a contact of the second connection object;

the housing comprising a front housing in which the first contacting portions are disposed and which is adapted to receive the first connection object and a rear housing in which the second contacting portions are disposed and which is adapted to receive the second connection object;

the first contacting portions of the pair of first signal contacts and the first contacting portion of the first ground contact being alternatively arranged in parallel in a first row extending in a widthwise direction perpendicular to an insert/remove direction of the first connection object;

the first contacting portions of the pair of second signal contacts and the first contacting portion of the second ground contact being alternatively arranged in parallel in a second row extending in the widthwise direction;

the first contacting portions of the pair of first signal contacts in the first row being faced to the first contacting portion of the second ground contact in the second row in a vertical direction perpendicular to the insert/remove direction of the first connection object and the widthwise direction;

the first contacting portions of the pair of second signal contacts in the second row being faced to the first contacting portion of the first ground contact in the first row in the vertical direction;

the second contacting portions of the pair of first signal contacts, the second contacting portion of the first ground contact, the second contacting portions of the pair of second signal contacts, and the second contacting portion of the other first ground contact being arranged in parallel in this order in a third row extending in the widthwise direction;

the second contacting portions of the second ground contacts being arranged in parallel in a fourth row extending in the widthwise direction, so as to contact to a solid ground conductor layer thickly formed on a surface of the second connection object;

the second contacting portions of the pair of first signal contacts and the second contacting portions of the pair of second signal contacts in the third row being faced to the second contacting portions of the second ground contacts through the solid ground conductor layer in the fourth row in the vertical direction.

8. The electrical connector according to claim 7, wherein:

the first signal contacts in each pair are formed so that the pitch between the second contacting portions in the widthwise direction is narrower than that between the first contacting portions;

the second signal contacts in each pair being formed so that the pitch between the second contacting portions in the widthwise direction is narrower than that between the first contacting portions;

the first ground contacts being connected at an intermediate portion between the first contacting portions and the second contacting portions through a connecting portion extending in the widthwise direction;

the first ground contacts being formed so that a plurality of the second contacting portions are formed in correspondence to each single first contacting portion;

the first ground contacts being formed so that the pitch between the second contacting portions in the widthwise direction is narrower than that between the first contacting portions;

the second ground contacts being connected at an intermediate portion between the first contacting portions and the second contacting portions through a connecting portion extending in the widthwise direction.

9. The electrical connector according to claim 8, wherein the connecting portion of the first ground contacts and the connecting portion of the second ground contacts are kept in contact with each other.

10. The electrical connector according to claim 7, further comprising a metal shell attached to a front surface of the front housing adapted to receive the first connection object removably inserted thereinto, the metal shell having an extending portion and a contacting element, the extending portion extending inward of the housing so as to face at least a part of each of the first contacting portions of the first and the second signal contacts, the contacting element being adapted to be brought into contact with a ground portion of the first connection object.

11. The electrical connector according to claim 7, wherein the first signal contacts in each pair and the second signal contacts in each pair are assigned to differential signal pairs, respectively.

* * * * *